United States Patent [19]

Migneau

[11] 4,023,881

[45] May 17, 1977

[54] CONNECTORS

[75] Inventor: Max Jacques Migneau, Fontenay-aux-Roses, France

[73] Assignee: Souriau et Cie, Boulogne-Billancourt, France

[22] Filed: Sept. 12, 1975

[21] Appl. No.: 612,748

[52] U.S. Cl. ..... 339/89 R; 339/74 R

[51] Int. Cl.² ..... H01R 13/54

[58] Field of Search ..... 339/74 R, 89 R, 89 M, 339/90 R, 90 C, 91 R, 91 P, 130 C, 201, 203

[56] References Cited

FOREIGN PATENTS OR APPLICATIONS 920,572 3/1963 United Kingdom ..... 339/90 R

*Primary Examiner*—Roy Lake
*Assistant Examiner*—E. F. Desmond
*Attorney, Agent, or Firm*—Larson, Taylor and Hinds

[57] ABSTRACT

The invention concerns connectors, more especially these, miniaturized or not, comprising a large number of contacts, with means, controlled by a locking ring, adapted to cause interpenetration of the contact pins into the corresponding sockets, after the two male and female parts have been suitably presented opposite one another by suitable grooves. According to said invention, means are provided which towards the end of the mechanical locking process, enable the contact pressure between pins and sockets to be increased, these means being for example manoeuvrable by complementary rotation in the mechanical locking ring. For example the sockets are designed so as to tend to be deformed, at rest, elastically towards a mininum pressure position, even nil pressure, and are each combined with a locking sleeve or the like adapted at the end of the relative insertion stroke of the pins, to tend to reclose said sockets to increase their contact pressure, the relative movement of said locking sleeve being obtained automatically at the end of the above-mentioned mechanical locking stroke.

12 Claims, 5 Drawing Figures

Fig. 2.
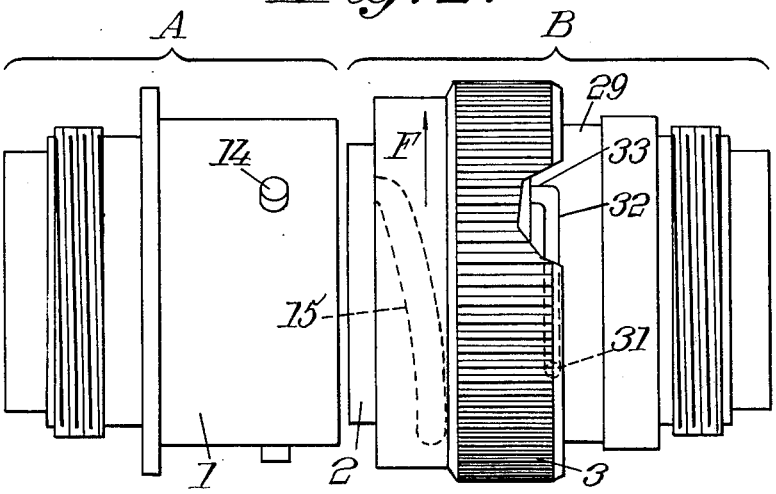
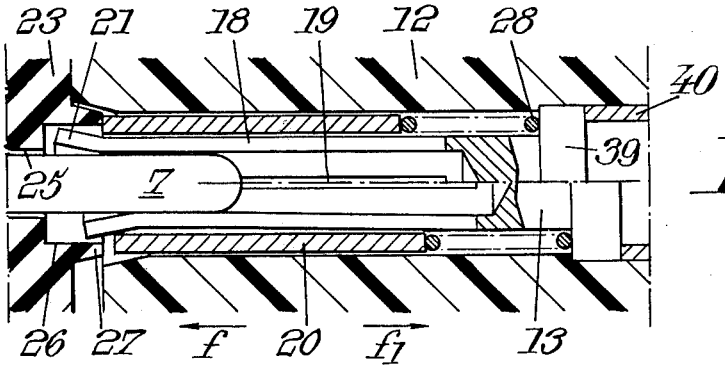
Fig. 3.
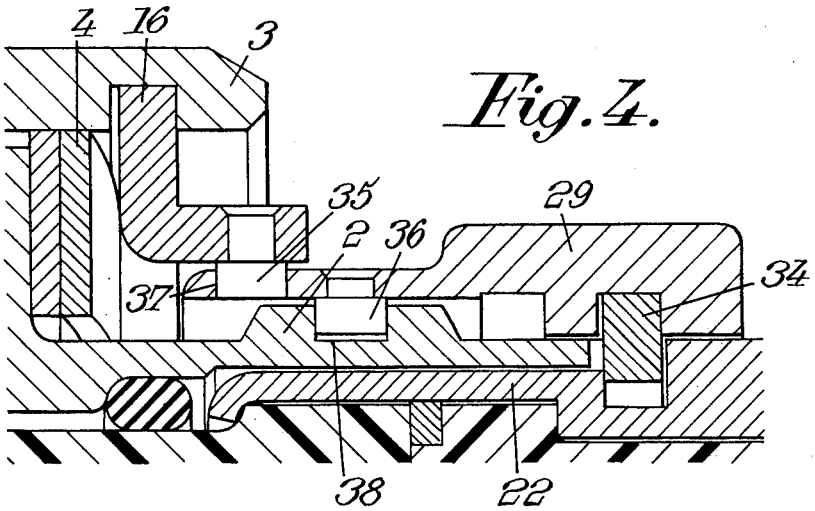
Fig. 4.

CONNECTORS

The invention relates to connectors, more especially to those, miniaturized or not, comprising a large number of contacts (for example a hundred contacts), wherein relatively large frictional forces arise on plugging in or on disconnection.

It is known that, in connectors of this type, mechanical locking means are generally provided, which are brought into action by manipulation of a ring. Once the two male and female parts have been suitably presented opposite one another by suitable guide grooves, the manipulation of the locking ring has the effect of bringing these two parts together, thereby causing interpenetration of the contact pins into the corresponding sockets, up to a final fully connected position.

To reach this position, frictional forces between the pins and the sockets must be overcome, and the sum of these forces can be considerable, if it is desired to produce good contacts. If it is desired to reduce these forces, it is at the expense of the completeness of these contacts.

According to the invention, it has been conceived to provide means which, towards the end of the mechanical locking process, enable the contact pressure between pins and sockets to be increased, these means being for example manoeuvrable by complementary rotation of the mechanical locking ring.

It may be arranged for example that the sockets are designed so as to tend to be deformed, at rest, elastically towards a minimum pressure position, even nil pressure, and are each combined with a locking sleeve or the like adapted at the end of the relative insertion stroke of the pins, to tend to reclose said sockets to increase their contact pressure, the relative movement of said locking sleeve being obtained automatically at the end of the above-mentioned mechanical locking stroke.

Thus, it is possible to ensure the coming into engagement of the male and the female parts of a connector with zero or low contact pressure and then to ensure automatically, at the end of the plugging in operation, as high a contact pressure as is desired.

According to a particular embodiment, the preceding operations are obtained from a contact pressure applying ring, driven by the mechanical locking ring in the last part of the stroke of the latter and adapted to bring the assembly of the socket and its locking sleeve into relative positions such that the gripping effect of the sleeve, obtained from a spring and until then kept in reserve, is released, thus ensuring the contact pressure.

The invention consists, apart from these principal features, of certain other features which are preferably used at the same time and which will be more explicitly considered below.

It relates, more particularly, to certain types of application —for example, those for which it is applied to multiple pin connectors, of very large number, for example for aviation, computers, etc. —, as well as certain embodiments of said features; and it relates more particularly again, and this by way of new industrial products, to connectors of the type concerned comprising the application of these same features, as well as the special elements adapted to their construction and assemblies comprising such connectors.

It will in any case be well understood by means of the additional description which follows, as well as of the accompanying drawings, which description and drawings are of course given primarily by way of indication. In the drawings:

FIG. 1, of these drawings, shows in axial section a variable position female contact connector, according to the invention, in the interlocked position, the female portion of said contact being shown, on both sides of the axis, respectively in two different operational positions.

FIG. 2 shows, on a smaller scale and in elevation, the two parts of the connector, before interlocking.

FIG. 3 shows separately, on a larger scale, the male and female contact elements, according to the invention.

FIG. 4 shows separately in partial axial section a modification of the embodiment of FIG. 1.

Figure 5:
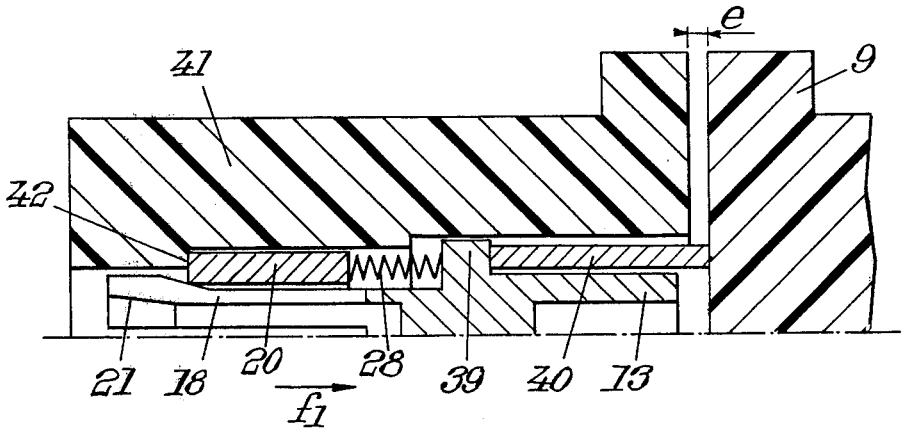

FIG. 5, lastly, shows diagrammatically a modification of the invention.

According to the invention and more especially according to those of its types of application, as well as according to those embodiments of its various parts, to which it appears that preference should be given, in order for example to construct a connector with male and female contacts, with mechanical locking, the procedure is as follows or in similar manner.

As regards the connector as a whole, with the exception of the means for causing the clamping pressure between the contacts to be modified, which will be considered below, it can be constructed in any customary suitable manner, the male A and the female B parts hence being able to comprise outer bodies 1 and 2 adapted to penetrate one into the other, in combination with an outer mechanical locking ring 3 adapted, once the respective sockets and pins of the two parts A and B have been engaged, to complete the movement until blocking occurs against the effect of a spring such as 4.

To simplify the drawings, a single pin and a single socket have been shown.

It is advantageous, as shown, and for reasons of standardization, to arrange that, in the female part B, access to the corresponding sockets is effected by means of male pins, so that the rear element of the part B is identical with the part A.

In this embodiment, it is seen that:

as regards firstly the part A, it comprises essentially its body 1, inside of which is mounted an insulator 5 with a rear base 6, the male pins 7 being borne by said insulator 5 and passing through a front plate 8, and, as regards the part B, it comprises mounted in the body 2 and in a manner which will be indicated below, the association of a first insulating assembly 9,10 (at the rear), identical with the assembly 5,6, and carrying male pins 11, with a second insulating assembly 12 (in the front) carrying female sockets 13 intended to come into contact, at the rear with the male pins 11, and at the front with the male pins 7 of the part A, the assembly cooperating with the ring 3, mounted outside the two bodies 1 and 2, and adapted, by being rotated in a certain direction F (FIG. 2), to bring together the two parts A and B, which is achieved for example by penetration of catch pins 14 of the male part A into grooves 15 positioned in the front part of the ring 3, whilst the rear part has drawn the body 2, at 16, in a manner which will be indicated below, against the action of spring 4 supported on a shoulder 17 of said body 2, the whole functioning, as regards the mechanical locking, in known manner.

Now, as regards more especially the female sockets 13 attached at the rear to pins 11 and cooperating in front, with the pins 7 of the male part A:

the front part of these sockets is arranged so that it tends to separate elastically towards a zero pressure position, this front part hence being advantageously constituted by flexible elements 18 separated by slots 19 and tending to separate from one another, with these extendable sockets are combined means tending to close them to obtain the desired pressure, which means are constituted for example, for each of them, by an outer sleeve 20 engaged on the extensible socket and adapted, when urged in a certain direction f (FIG. 3) to close the socket 18 by acting on flared ends 21 formed in the latter, and, to ensure the operational function of these sleeves 20, a relative displacement of the assembly 9, 12, with respect to the outer body 2, is provided at the end of the interlocking movements of the parts A and B.

In this embodiment (it being understood that any others could be provided, within the scope of the invention, to ensure, the general operation described), it will be seen in the drawing that the assembly 9, 12, instead of being fixed in the body 2, is fixed in an intermediate body 22, which will be displacable by means described below.

The front part of said assembly, which supports the sockets 13 and 18 and the sleeves 20 can hence undergo slight axial movements with respect to the body 2.

In the normal inactive position, before the coming into engagement of the parts A, B, the insulating block 12 comes into abutment against an insulating front wall 23 fast to the body 2 by means of a bushing 24. This wall is pierced by holes for the passage of the pins 7 (FIG. 3) of the male part A, which holes open, on the side of the female part B, in gaps 26 appearing in line with sockets 18, 21. In addition, these gaps are defined by projecting collars 27 against which the sleeves 20 come into abutment, whilst being movable against the effect of springs 28.

It is hence seen that, in the above-mentioned inactive position, with contact of the block 12 against the front wall 23, each sleeve 20 is pushed rearwardly by its contact with the collar 27, against the effect of its spring 28, so that it releases the flared ends 21 and that thus the flexible socket element 18 takes up its position of maximum expansion (position shown in the upper half of FIG. 3). This position is held during the major part of its mechanical locking stroke, so that the penetration of the pins 7 is realized effortlessly.

The spring 28 is supported, at the rear, on a shoulder 39 fast to the sockets 18 and 13, which shoulder is itself positioned by a crosspiece 40.

Starting from this inactive position, if now, by means which will be described, there is imparted to the assembly 9, 12 a slight axial movement in the direction $f_1$ tending to separate it from the wall 23 (position shown in the lower half of FIG. 3), each sleeve 20 is released from the collar 27 and hence comes, under the effect of its spring 28, to act in the direction $f$ on the flared ends 21 to grip the socket 18 against the pin 7, the desired contact pressure thus being obtained.

Now as regards means for effecting the final movement, in the direction $f_1$, of the block 9, 12, it is effected for example by kinematic means interposed between, on one hand, the above-mentioned mechanical locking ring 3, and on the other hand, the intermediate body 22 bearing the block 9, 12, this in such a way that, towards the end of the mechanical locking stroke of said ring, the driving of said block in the direction $f_1$ is caused.

Thus the above-said means can be constituted by a second drive ring 29, for example screwing at 30 onto the main body 2 and suitably connected, on one hand, to the ring 3, and on the other hand, to the intermediate body 22.

The connection with the ring 3 is effected for example by means of a catch pin borne by the part 16 drawn by said ring 3 and adapted to cooperate with a groove 32, formed on the front part of the ring 29.

The groove 32 has a rectilinear principal part arranged in a transverse plane, so that the rotation of the ring 3 has the effect simply of drawing the ring 2 without making it rotate: this corresponds to the main mechanical locking stroke of the ring 3.

However, said groove 32 ends in a part 33 directed axially, so that, when the roller catch pin 31 reaches this part 33, it can draw the ring 29 into relative rotation with respect to the body 2. At this moment, through a drive washer 34 interposed between ring 29 and intermediate body 22, and due to the screw 30, the desired relative axial movement of said body, and, consequently of the block 9, 12, in the direction $f_1$ is caused. There is thus produced, by withdrawal of the block 9, 12 (which withdrawal is indicated at $e$ in FIG. 1), compression of the sockets 18 under the effect of the sleeve 20.

Another embodiment is shown in FIG. 4, according to which embodiment the ring 29 is constantly rotated by the ring 3, for example by means of pegs 35, 36 cooperating with grooves or channels 37, 38 in such a way that the ring 39 undergoes, towards the end of the rotation of the ring 3, relative translation in the direction $f_1$, which translation is communicated at 34 to the intermediate body 22. The necessary locking then remains ensured in any case by the spring 4.

Any other kinematic arrangement could be conceived for the same purpose.

In FIG. 5, there is illustrated, still by way of example, a modification in which the relative movements of the sleeve 20 and of the socket 18 are reversed.

Figure 1:
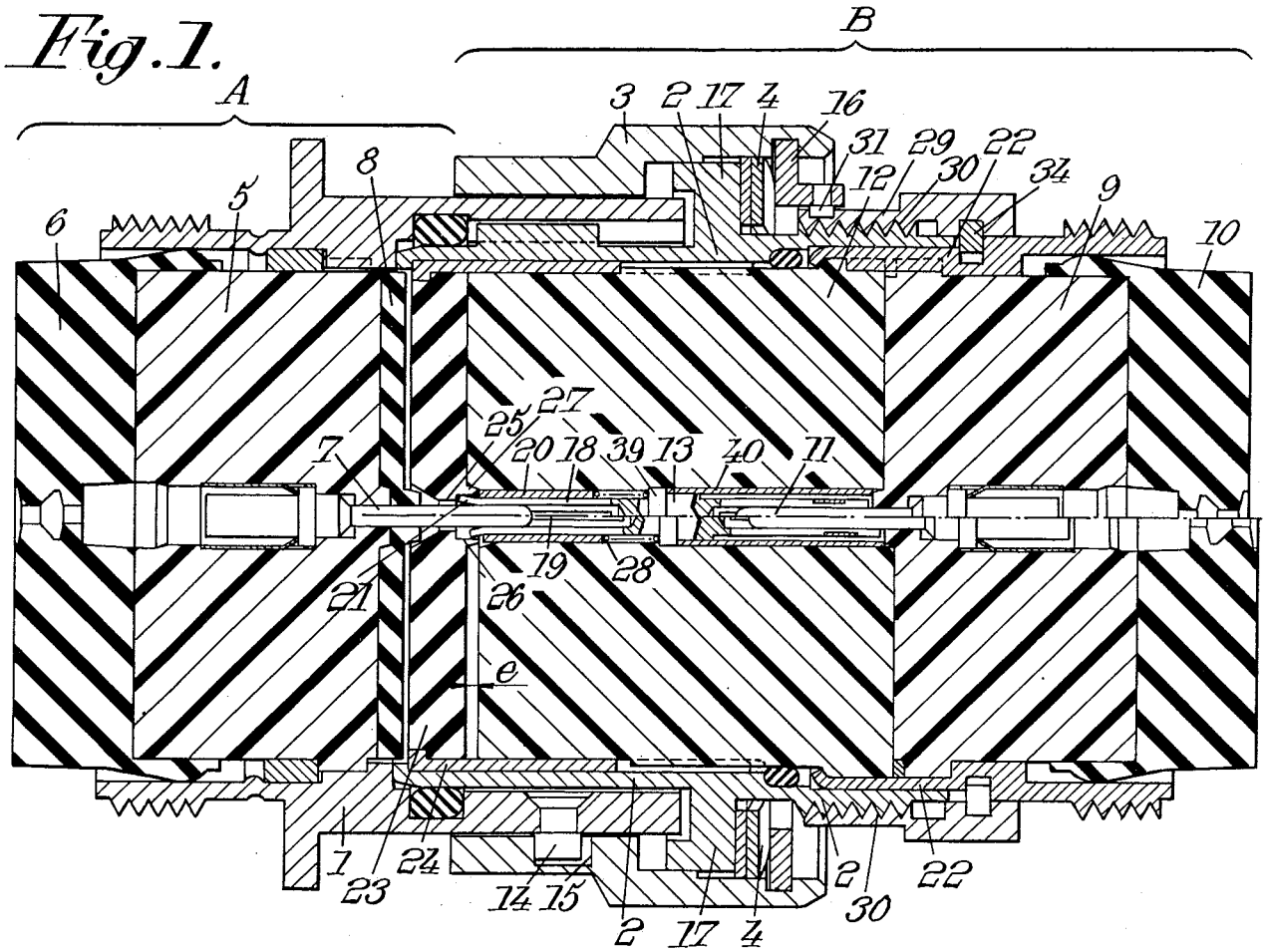

In this modification, the insulating parts 12 and 23 of FIGS. 1 and 3 are replaced by a single fixed part 41, that is to say fast to the outer body 2 illustrated in FIG. 1, and the sleeve 20 is normally fixed, by abutting against a stop 42 of the part 41, under the action of the spring 28 urged on the other hand on the shoulder 39. The crosspiece 40 is inserted between said shoulder and the insulating part 9 removable under the same conditions as described above with reference to FIGS. 1 to 4.

In inactive position, the parts 41 and 9 are for example in contact, and the flared ends 21 of the extendable socket 18 are not subject to the action of the sleeve 20. On the other hand, when, as assumed in FIG. 5, the connection is effected, at the end of the latter, the part 9, with the assembly of sockets 18 and 3 separate in the direction $f_1$ from the part 41 (space $e$, FIG. 5), so that the flared ends 21 are subject to the action of the sleeve 20, itself receiving the effect of the spring 28. Contact pressure is thus produced, or electrical locking. Numerous other modifications are of course possible.

As a result of which, whatever the embodiment adopted, a connector can be obtained whose operation emerges sufficiently from the foregoing for it to be unnecessary to dwell further on the subject and which has with respect to prior connectors of the type concerned, many advantages, for example:

that of enabling the coming into engagement of the elements of the connector with a contact pressure as small as desired, that however of obtaining finally a high contact pressure, and that of only comprising members which are standardized and of a simple type.

In all cases, the manipulations, for the coming into engagement of the male and female parts, operate in normal manner, that is to say:

presentation of the two male and female parts so as to bring the pins and sockets opposite each other, mechanical locking, and lastly, the mechanical locking being continued, the bringing into action of a true electrical locking by the compression of the female sockets which, up to this point, had remained in an uncompressed state, the same operation being produced in the reversed direction on disconnection.

As is self-evident and as emerges already from the foregoing, the invention is in no way limited to those of its types of application and embodiment which have been more especially envisaged; it encompasses on the contrary all modifications.

I claim:

1. A connector comprising male and female members having respective contact elements, at least one male and one female, to be coupled and uncoupled in a plugged-in manner, said female contact element being selectively expandable and contractable so as, respectively, to permit entry of the male contact element with relatively little resistance and to exert relatively increased contact pressure on the inserted male member, an actuatable movable mechanical locking ring carried by said female member, said locking ring having means thereon for cooperating with mating means on said male member to permit axial penetration and joining of said contact elements upon actuation and movement of said locking ring relative to said female member and to effect mechanical locking of the male member to the female member at the end of the movement of said locking ring, and means responsive to said movement and the posi tion of said locking ring for automatically ensuring expansion of said female contact element during the first part of said movement of said locking ring and attendant penetration and joining of said contact elements and automatically effecting contraction of said female contact element during the last part of continued movement and the attendant locking of said members after said penetration and joining.

2. A connector as claimed in claim 1 wherein said locking ring is rotatable, and said movement is rotation.

3. A connector as claimed in claim 1 wherein said means for effecting expansion and contraction of said female contact element includes a pressure member movable relative to said female element between active contraction and inactive expansion positions, said female contact element being supported in a relatively movable insulating assembly which is movable with respect to a relatively stationary insulating assembly carried by said female member, the relative movements of said assemblies effecting the active or inactive state of said pressure member.

4. A connector as claimed in claim 3 wherein said female element comprises a socket with a flared end, and said pressure member comprises a spring loaded sleeve which is relatively moved into its inactive position when said insulating assemblies move into contact with each other and is freed to be relatively spring biased into its active position to contract said socket when said assemblies are moved apart.

5. A connector as claimed in claim 4 wherein said socket and said sleeve are carried by said relatively movable insulator assembly, with said sleeve being axially movable thereon, said stationary insulating assembly including an abutment surface for encountering said sleeve and moving it to its inactive position when said insulator assemblies move into contact, and freeing said sleeve to be spring biassed to its active contraction position when said assemblies move apart.

6. A connector as claimed in claim 4 wherein said sleeve is in abutment on a relatively fixed insulating assembly in which said socket is relatively movable, said socket at its rear operatively abutting an insulator assembly movable relatively to said relatively fixed insulating assembly, the separation of said assemblies causing relative movement of said socket with respect to said sleeve such that said sleeve is in its active contraction state.

7. A connector as claimed in claim 3 wherein said means for effecting expansion and contractor of said female contact element includes means responsive to predetermined movement of said locking ring for moving said insulator assemblies axially toward and away from each other.

8. A connector as claimed in claim 7 wherein said last mentioned means includes a further rotatable ring, predetermined rotation of which effects said axial movements of said insulator assemblies.

9. A connector as claimed in claim 8 wherein said predetermined rotation occurs at the end of the axial penetration of said contact elements, actuated by said locking ring.

10. A connector as claimed in claim 9 wherein said further rotatable ring is screw mounted on said female member, and is coupled to said locking ring so as to rotate during only part of the movement thereof.

11. A connector as claimed in claim 10 wherein said locking ring is coupled to said further rotatable ring by a pin riding in a groove which, during the major part of said mechanical locking, draws the further rotatable ring axially without causing it to rotate, but causes its rotation at the end of said mechanical locking.

12. A connector as claimed in claim 9 wherein said further rotatable ring is coupled to said locking ring by at least one cooperating peg and groove arrangement for ensuring a first axial movement of said further rotatable ring in the direction of the axial penetration movement, and then a slight movement in the opposite direction.

* * * * *